US007319837B2

(12) United States Patent
Ahn

(10) Patent No.: US 7,319,837 B2
(45) Date of Patent: Jan. 15, 2008

(54) DEVELOPING UNIT AND ELECTROPHOTOGRAPHIC IMAGE FORMING APPARATUS HAVING THE SAME

(75) Inventor: Byung-sun Ahn, Suwon-si (KR)

(73) Assignee: Samsung Electronics Co, Ltd., Suwon-si (KR)

( * ) Notice: Subject to any disclaimer, the term of this patent is extended or adjusted under 35 U.S.C. 154(b) by 31 days.

(21) Appl. No.: 11/033,861

(22) Filed: Jan. 13, 2005

(65) Prior Publication Data

US 2005/0185990 A1 Aug. 25, 2005

(30) Foreign Application Priority Data

Feb. 21, 2004 (KR) ..... 10-2004-0011676

(51) Int. Cl.
*G03G 15/08* (2006.01)

(52) U.S. Cl. ..... 399/258; 399/120; 399/106

(58) Field of Classification Search ..... 222/DIG. 1; 399/120, 106, 258, 262
See application file for complete search history.

(56) References Cited

U.S. PATENT DOCUMENTS 5,960,238 A 9/1999 Ohgami
6,272,298 B1 * 8/2001 Yamaguchi et al. ..... 399/106
6,330,411 B1 * 12/2001 Suzuki ..... 399/120
6,463,243 B1 10/2002 Boogert et al.

FOREIGN PATENT DOCUMENTS

| | | |
|---|---|---|
| JP | 03-69974 | 3/1991 |
| JP | 03-87776 | 4/1991 |
| JP | 09-230684 | 9/1997 |
| JP | 11-174816 | 7/1999 |
| JP | 2002-49291 | 2/2002 |
| JP | 2002-108079 | 4/2002 |
| JP | 2002-108084 | 4/2002 |

* cited by examiner

*Primary Examiner*—Hoang Ngo
(74) *Attorney, Agent, or Firm*—Stanzione & Kim, LLP

(57) ABSTRACT

A developing unit to develop an image by supplying a developer to a photosensitive medium on which an electrostatic latent image is formed, the developing unit includes a container containing a developer and barriers to partition a portion from other portions of an inside of the container, and a space defined by the barrier is not filled with the developer. Also, an electrophotographic image forming apparatus equipped with a photosensitive medium, on which an electrostatic latent image is formed on an outer surface of the photosensitive medium by light scanning, and a developing unit to develop an image by supplying a developer to the photosensitive medium, the apparatus includes the developing unit as described above.

27 Claims, 4 Drawing Sheets

DEVELOPING UNIT AND ELECTROPHOTOGRAPHIC IMAGE FORMING APPARATUS HAVING THE SAME

CROSS-REFERENCE TO RELATED APPLICATIONS

This application claims the benefit of Korean Patent Application No. 2004-11676, filed on Feb. 21, 2004, in the Korean Intellectual Property Office, the disclosure of which is incorporated herein in its entirety and by reference.

BACKGROUND OF THE INVENTION

1. Field of the Invention

The present general inventive concept relates to a developing unit in which a developer is supplied to a photosensitive medium to develop an image and an electrophotographic image forming apparatus having the same, and more particularly, to a developing unit having an improved configuration in which a residual developer is reduced in a consumed developing unit and an electrophotographic image forming apparatus having the same.

2. Description of the Related Art

Generally, an electrophotographic image forming apparatus, such as a laser printer, a facsimile, and a digital copier, scans light on a photosensitive medium charged with a predetermined electric potential, forms an electrostatic latent image, develops the electrostatic latent image with a developer having a predetermined color into a visual image, transfers the image on a sheet of paper, and fixes the image on the sheet of paper to print an image.

FIG. 1 is a cross-sectional view of a conventional electrophotographic image forming apparatus. Referring to FIG. 1, an electrophotographic image forming apparatus includes a case 10 equipped with a charge roller 11, a photosensitive medium 13, a light scan unit 15, a developing unit 20, a transfer roller 17, and a fixing roller 19.

An outer surface of the photosensitive medium 13 is charged with a predetermined electric potential via the transfer roller 11, and an electrostatic latent image corresponding to an image to be printed is formed with a light beam L scanned from the light scan unit 15.

The developing unit 20 has a container 25 in which toner, a developer T, is contained. The developer T is supplied to the photosensitive medium 13 on which the electrostatic latent image is formed to develop an image on the outer surface of the photosensitive medium 13 through an agitator 27, a supply roller 24, and a developing roller 21. The developing unit 20 is formed of a single cartridge with the photosensitive medium 13 and the container 25 containing the developer T, and when all the developer T contained in the container 25 is consumed, the developing unit 20 is changed with a new developer T.

In the developing roller 21, a direct current voltage is applied via a source supply portion (not shown) in order to transfer the developer T supplied in the developing unit 20 using an electrophotographic method to the electrostatic latent image formed on the photosensitive medium 13. A regulation blade 23 regulating a developer amount is provided on the outer surface of the developing roller 21. The developer T transmitted from the developing unit 20 via the developing roller 21 passes between the regulation blade 23 and the developing roller 21 to form a developer layer having a predetermined thickness. Also, a waste developer container 29 containing a waste developer W gathered by a cleaning blade 12 after development is provided in the developing unit 20.

Also, the developing unit 20 includes a sealing film 26 to keep the developer T contained in the container 25 in a sealed state. The sealing film 26 separates the developer T from the agitator 27, the supply roller 24, and the developing roller 21 to keep the developer T sealed in the container 25. Accordingly, the developer T in the container 25 is kept in an initial state until an initial use. That is, the sealing film keeps the developer T stable from changes due to external temperature and humidity, and protects the developer T from leaking. When the developing unit 20 is used for a first time, the sealing film 26 is removed by a user and the developing unit 20 is installed in the case 10.

The electrophotographic image forming apparatus prints an image on paper P supplied via a first or a second paper feeding cassette 31 and 35 and includes a feeding path 41 and a discharge path 45 of the paper P. Pickup rollers 32 and 36 picking up a sheet of the paper P, a feed roller 33 guiding the supply of the picked up paper P, and registration roller 42 for assuring development of an image on a desirable position of the fed paper P are provided on the feeding path 41. The fixing roller 19 and a plurality of discharge rollers 47 are provided on the discharge path 45.

As described above, the image developed on the outer surface of the photosensitive medium 13 is transferred onto the paper P supplied from the first or second feeding cassette 31 and 35 and fed between the photosensitive medium 13 and the transfer roller 17 via the feeding path 41, and is fixed by the fixing roller 19. The paper P on which the image is printed is discharged onto a loading portion 50 provided on the upper portion of the case 10 via the discharge path 45.

The developing unit 20 includes a residual developer detecting sensor 22 for detecting residual of the developer T contained in the container 25. The residual developer detecting sensor 22 is electrically connected to a controller (not shown) in the electrophotographic image forming apparatus. When a residual of the developer T is sensed under a standard value by the residual developer detecting sensor 22, the controller informs the user of the requirement of changing the developing unit 20.

The container 25 in the developing unit 20 may be of different sizes. When the container 25 is replaced with a container of a different size, a new metal mold for the container has to be provided, thereby increasing a manufacture cost. Also, containers 25 of the same size may contain different amounts of the developer T.

All of the developer T provided in the container 25 is not used to print images. Some of the developer T provided in the container 25 remains inside the container 25 until the developing unit 20 is changed, and a residual developer amount in the same type of containers 25 is generally the same. Accordingly, when a small amount of the developer T is provided, waste of the developer T is greater than in a case where a large amount of the developer T is provided. Also, when the developer T is charged without considering a characteristic of the residual developer amount, a difference between an expected number of printed sheets and an actual number of printed sheets increases. Also, when the residual developer is not properly gathered, environmental pollution is caused.

SUMMARY OF THE INVENTION

The present general inventive concept provides a developing unit in which a developer waste is not increased even when a small amount of developer is provided in a container, and an electrophotographic image forming apparatus having the same.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a developing unit to develop an image by supplying a developer to a photosensitive medium on which an electrostatic latent image is formed, the developing unit comprising a container containing a developer and barriers partitioning a portion from other portions within the container, and a space defined by the barriers is not filled with the developer.

A sealing film to partition a space inside of the container capable of unifying the container by being removed without disassembling the container may be provided, and the barrier may be provided in the space inside the container partitioned by the sealing film.

The sealing film may be disposed to partition the container into a top space and a bottom space, and spaces defined by the barriers may be provided in the same side of the top space and bottom space.

Slits in which end portions of the barriers are inserted may be formed in an inside surface of the container.

The foregoing and/or other aspects and advantages of the present general inventive concept may also be achieved by providing an electrophotographic image forming apparatus equipped with a photosensitive medium, on which an electrostatic latent image is formed on an outer surface of the photosensitive medium by light scanning, and a developing unit to develop an image by supplying a developer to the photosensitive medium, the developing unit comprising a container containing the developer, and barriers capable of being attached and detached to partition the container, in which a space defined by the barriers is not filled with the developer.

A sealing film to partition a space inside of the container and capable of unifying the container by being removed without disassembling the container may be provided, and the barriers may be provided in the space inside the container partitioned by the sealing film.

The sealing film may be disposed to partition the container into a top space and a bottom space, and spaces defined by the barriers may be provided in the same side of the top space and bottom space.

Slits in which end portions of the barriers are inserted may be formed in the inside surface of the container.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
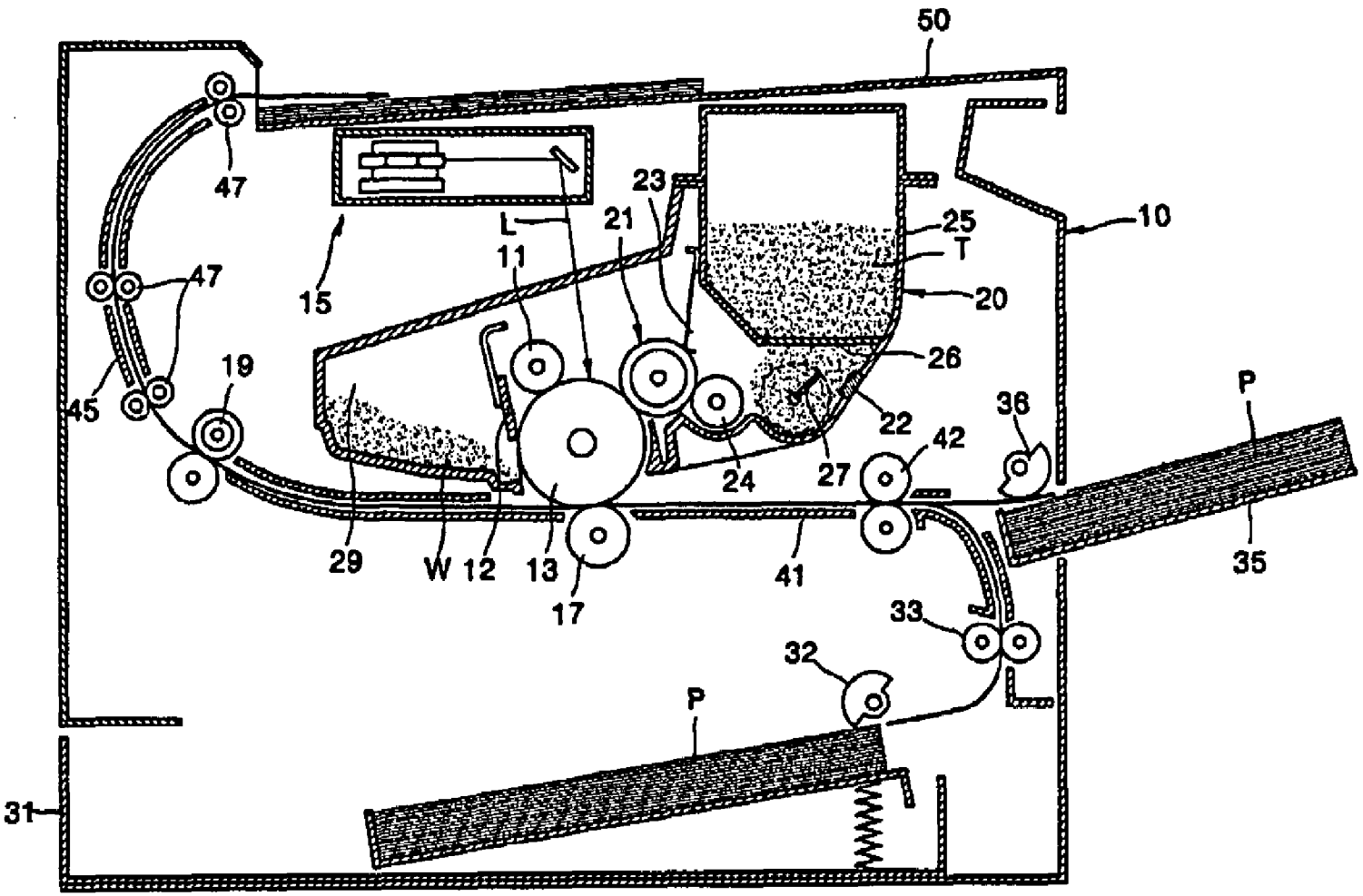
FIG. 1 (PRIOR ART)
FIG. 1 is a cross-sectional view of a conventional electrophotographic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
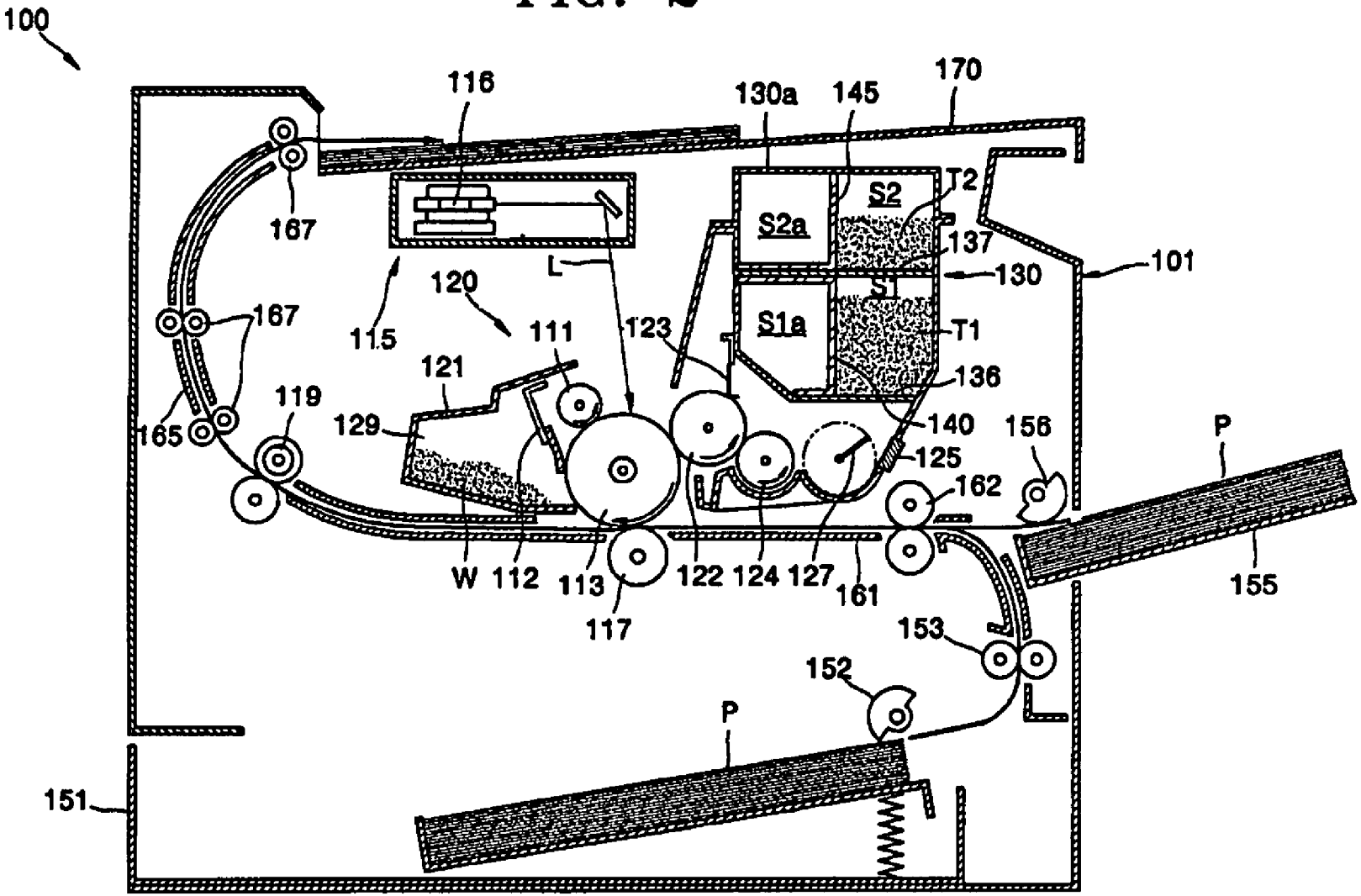
FIG. 2 is a schematic cross-sectional view of an electrophotographic image forming apparatus according to an embodiment of the present general inventive concept.
Figure 3:
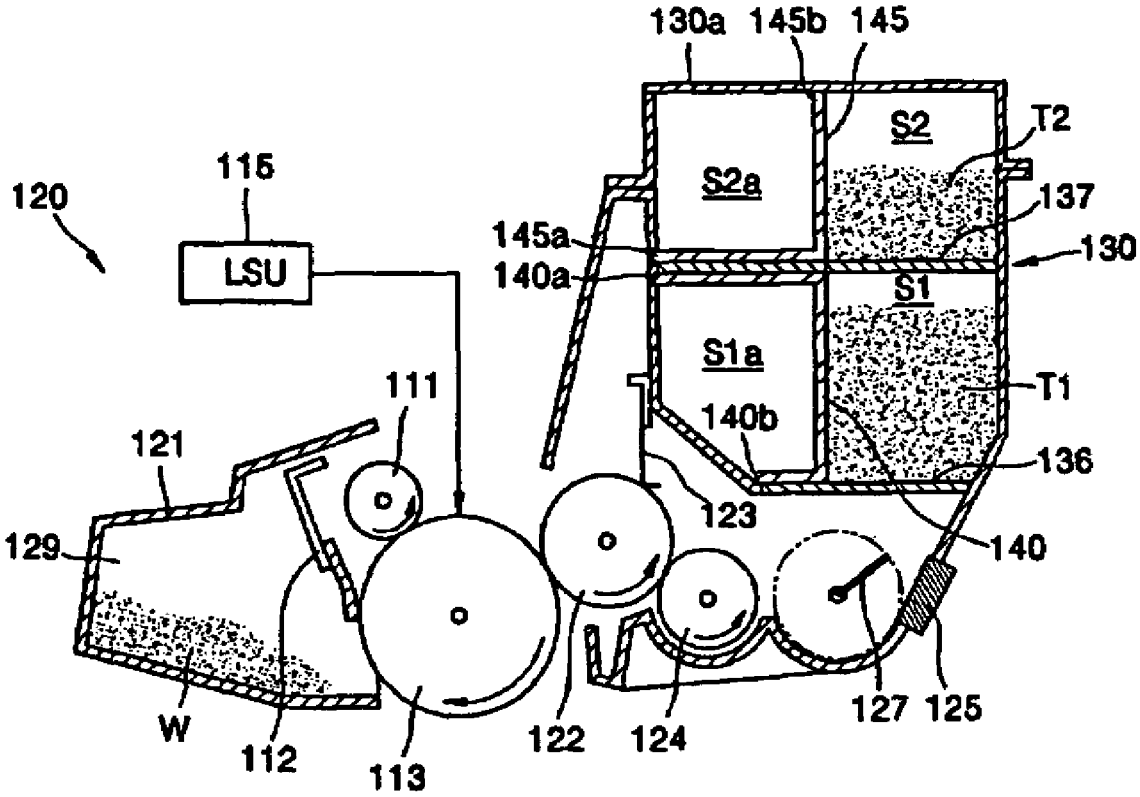
FIG. 3 is a schematic cross-sectional view of a developing unit of FIG. 2.
Figure 4:
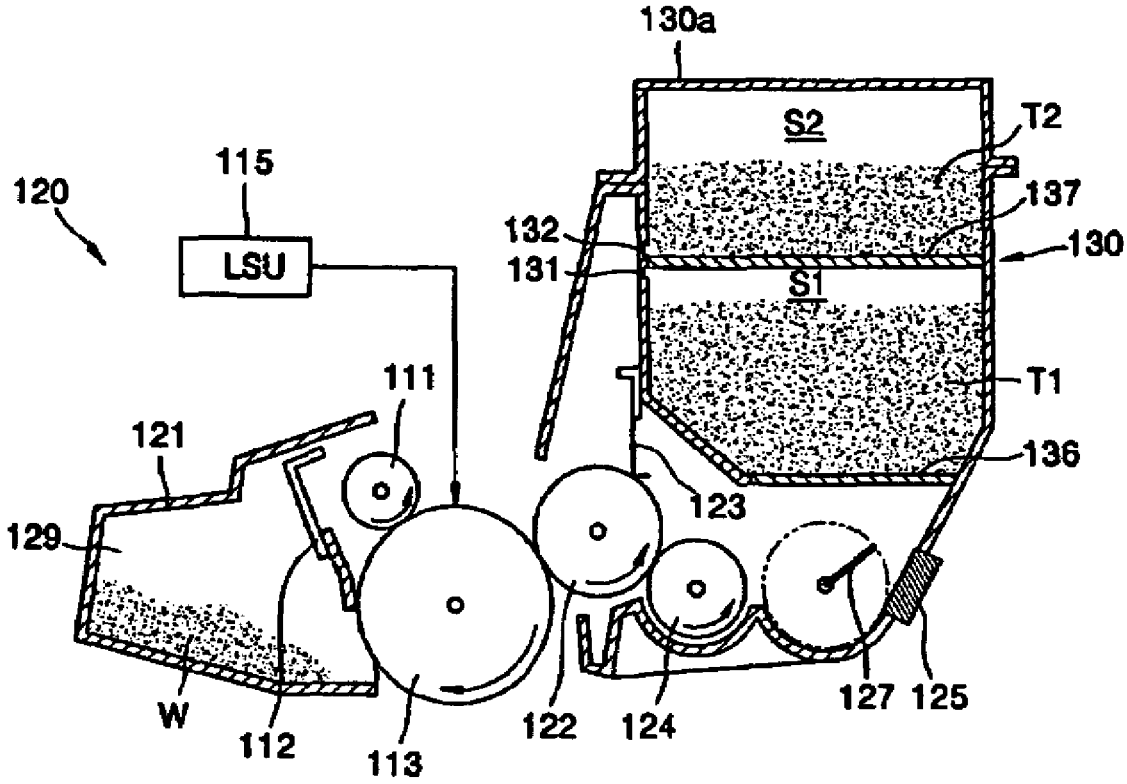
FIG. 4 is a schematic cross-sectional view of the developing unit of FIG. 3 in which barriers are removed.

FIG. 2 is a schematic cross-sectional view of an electrophotographic image forming apparatus according to an embodiment of the present general inventive concept, FIG. 3 is a schematic cross-sectional view of a developing unit of FIG. 2, and FIG. 4 is a schematic cross-sectional view of the developing unit of FIG. 3 in which barriers are removed.

Referring to FIGS. 2 and 3, an electrophotographic image forming apparatus 100 according to an embodiment of the present general inventive concept can include a case 101 equipped with a photosensitive medium 113, a light scan unit 115, a developing unit 120, and a transfer roller 117.

The photosensitive medium 113 can be installed to rotate inside a housing 121 of the developing unit 120. The photosensitive medium 113 is charged to a predetermined electric potential via a charger 111, and an electrostatic latent image corresponding to an image to be printed is formed on an outer surface of the photosensitive medium 113 by light L scanned from the light scan unit 115. Referring to FIG. 2, although the charger 111 may be formed of a roller, a charger 111 formed of a belt may also be used.

The light scan unit 115 scans the light L at the photosensitive medium 113 charged to the predetermined electric potential in order to form the electrostatic latent image corresponding to the image to be printed. The light scan unit 115 can include a light source (not shown) to irradiate a laser beam and a beam deflection device to deflect the laser beam irradiated from the light source. Referring to FIG. 2, a polygonal rotating mirror 116 that is rotated by a driving source and scans light may be employed as the beam deflection device. On the other hand, a hologram disc (not shown) that deflects and scans light by diffraction of a hologram pattern formed on the surface of a disc may be employed instead of the polygonal rotating mirror 116 as the beam deflection device.

The developing unit 120 includes the housing 121, a developing roller 122 provided in the housing 121, and a container 130 containing developers T1 and T2, such as toner powder.

The developing unit 120 can also include an agitator 127 and a supply roller 124 used to supply the developers T1 and T2 contained in the container 130 to the developing roller 122. The agitator 127 is located below the container 130 and agitates the developers T1 and T2 supplied from the container 130 to prevent coagulating so that the developers T1 and T2 are supplied smoothly to the supply roller 124. The developing roller 122 is disposed to form a nip with the photosensitive medium 113. A direct current voltage is applied to the developing roller 122. Accordingly, the developers T1 and T2 are supplied to the electrostatic latent image formed on the outer surface of the photosensitive medium 113 to develop the image desired to be printed.

The developing unit 120 can also include a regulation blade 123 to regulate the amount of the developers T1 and T2 provided on the outer surface of the developing roller 122. The regulation blade 123 can be fixed at an outside wall of the container 130 such that an end portion of the regulation blade 123 contacts the outer surface of the developing roller 122. The regulation blade 123 regulates the supplied amount of the developers T1 and T2 transported to the photosensitive medium 113 via the developing roller 122. A waste developer container 129 containing waste developer W gathered by a cleaning blade 112 after development can be provided in the developing unit 120.

Also, the developing unit 120 can include a residual developer detecting sensor 125 to detect residual of the developers T1 and T2 in the housing 121. Referring to FIGS. 2 through 4, the residual developer detecting sensor 125 can be installed on a surface of the housing 121 below the container 130 and can be electrically connected to a controller (not shown) in the electrophotographic image forming apparatus 100. The residual developer detecting sensor 125 may be a pressure sensor, a photo sensor, an electrostatic amount sensor, or a pixel coefficient sensor. When data of the residual of the developers T1 and T2 sensed by the residual developer detecting sensor is under a standard value, the controller informs a user that a sealing film 137 should be removed or that changing the developing unit 120 is necessary via a display panel (not shown) of the electrophotographic image forming apparatus 100.

A loading portion 170 onto which printed media are discharged can be provided on the outside of the case 101. Also, the case 101 can be equipped with a first and second paper feeding cassettes 151 and 155 on which sheets of printing paper P to be fed are loaded, and the first and second paper feeding cassettes 151 and 155 can be attached to or detached from the case 101.

The electrophotographic image forming apparatus 100 prints images on the printing paper P or other printing media fed from the first and second paper feeding cassettes 151 and 155, and has a feeding path 161 and discharge path 165 of the printing paper P. Here, a pickup roller 152 or 156 to pick up a sheet of the printing paper P, a feed roller 153 to guide supply of the printing paper P picked up, and a registration roller 162 to develop the image on a desirable position of the printing paper P can be included in the feeding path 161. A fixing roller 119 and a plurality of discharge rollers 167 can be provided in the discharge path 165.

The image developed on the outer surface of the photosensitive medium 113 is transferred onto the printing paper P and is fixed by the fixing roller 119. The printing paper P can be supplied from the first or second paper feeding cassette 151 or 155 and is fed between the photosensitive medium 113 and the transfer roller 117 via the feeding path 161. The printing paper P, having an image printed thereon by the process as described above, is then discharged onto the loading portion 170 provided on the upper portion of the case 101 through the discharge path 165.

Hereinafter, the container 130 according to an embodiment of the present general inventive concept will be described in detail.

The container 130 can include a first sealing film 136 at a lower end portion of the container 130 to separate an inside of the container from other elements in the housing 120, and can include a second sealing film 137 at a center of the container 130 to partition an inside space of the container 130 into a first space S1 and a second space S2 capable of being unified.

End portions of the first and second sealing films 136 and 137 can project outside the housing 121 (i.e., from the side wall of the housing) so that the first and second sealing films 136 and 137 can be removed without disassembling the container 130. A user can remove the sealing films 136 and 137 by pulling the end portions of the first and second sealing films 136 and 137.

The developers T1 and T2 can be provided and kept in the first space S1 and the second space S2, respectively, not to leak out until the sealing films 136 and 137 are removed. The first and second sealing films 136 and 137 are composed of a material which can support the weight of the developers T1 and T2 contained respectively in the first and second space S1 and S2 such as, for example, paper, urethane, polyethylene series, and polypropylene series.

A first barrier 140 can be provided in the first space S1, and a second barrier 145 can be provided in the second space S2. The first and second barriers 140 and 145 partition portions of the first space S1 and the second space S2 from other portions of the first space S1 and the second space S2, thereby forming a first surrounded space S1*a* and a second surrounded space S2*a* partitioned by the barriers 140 and 145 and an inside surface of the container 130. The first surrounded space S1*a* and the second surrounded space S2*a* can be provided in the bottom and top of the container 130 at the same side, referring to FIG. 3, for example, at a left side. There is no developer in the first surrounded space S1*a* and the second surrounded space S2*a*.

The barriers 140 and 145 can have various forms according to the size and the shape of the first and second surrounded spaces S1*a* and S2*a*, and the size and shape of the section of the barriers 140 and 145 are not restricted to those shown in FIG. 3. A first slit 131 and a second slit 132 as illustrated in FIG. 4 can be provided in the inside surface of the container 130, and end portions 140*a* and 145*a* of the first and second barriers 140 and 145 can be inserted in the first and second slits 131 and 132 so that the first and second barriers 140 and 145 are attached to the inside surface of the container 130. Other end portions 140*b* and 145*b* of the first and second barriers 140 and 145 can contact the inside surface of the container 130 in order to protect the first and second surrounded space S1*a* and S2*a* from the inflow of the developers T1 and T2. However, a configuration is possible in which slits are provided such that the other end portions 140*b* and 145*b* of the first and second barriers 140 and 145 can be attached to the inside surface of the container 130 in the same way as the end portions 140*a* and 145*a*.

When the developing unit 120 is mounted in the electrophotographic image forming apparatus 100 to print an image, the first sealing film 136 is removed from the housing 121 of the developing unit 120. Then, the developer T1 contained in the first space S1 falls down on the agitator 127 by its own weight and image printing becomes possible.

When the developer T1 contained in the first space S1 is consumed and the amount of the developer T1 adjacent to the agitator 127 is sensed to be under a standard value by the residual developer detecting sensor 125, a message that the second sealing film 137 has to be removed can be displayed on a display panel (not shown) of the electrophotographic image forming apparatus 100. When a user views the message and removes the second sealing film 137 from the housing 121, the developer T2 contained in the second space S2 falls down on the agitator 127 by its own weight and image printing can continue to be performed. In this case, since the first and second surrounded space S1*a* and S2*a* are disposed at the left side of the container 130, the developer T2 can easily fall down on the agitator 127 when the second sealing film 137 is removed.

The developer T2 contained in the second space S2 does not fall down on the agitator 127 before the second sealing film is removed, thereby reducing stress in the developer T2 generated by the agitator 127. The stress of a developer means that a charge assistant coating the developer and an additional material such as wax are separated from the developer that is being agitated for a long time, thereby deteriorating printing quality. Since the developer T1 contained in the first space S1 and the developer T2 contained in the second space S2 are sealed and used sequentially, the developers T1 and T2 are exposed to the agitator 127 for a short time and the stress thereof is reduced.

The first and second barriers 140 and 145 can be removed as shown in FIG. 4. The developing unit 120 of FIG. 3, in which the barriers 140 and 145 are installed, can be made as the configuration shown in FIG. 4 by a method in which a container cover 130*a* is opened, the barriers 140 and 145 are removed from the slits 131 and 132, and the container cover 130*a* is closed. On the other hand, the configuration of FIG. 4 can also be changed into the configuration of FIG. 3.

The developing unit 120 of FIG. 4 can be provided to a user who requires a large capacity image forming apparatus provided with a large amount of the developer T1 and T2. The developing unit 120 of FIG. 3, in which the barriers 140 and 145 are installed and the developer T1 and T2 is not provided in the first and second surrounded space S1*a* and S2*a*, can be provided to a user who requires a small capacity image forming apparatus provided with a small amount of the developer T1 and T2.

Effects of the developing unit according to an embodiment of the present general inventive concept and an electrophotographic image forming apparatus are as follow.

First, a housing and container of a developing unit of variable size can be provided regardless of developer capacity to be used.

Second, even if a small amount of a developer is provided, a residual developer amount is reduced by installing barriers in the container, and thereby the developer consumption is relatively decreased. Also, since the residual developer amount is reduced, environmental pollution caused by wasted developers is decreased.

Third, although a developer is provided without considering a residual developer, and the number of the expected printed sheets is determined in proportion to an addition and reduction rate of the amount of the developer provided, an error between the expected number of printed sheets and the actual number of printed sheets can be decreased.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing unit to develop an image by supplying a developer to a photosensitive medium on which an electrostatic latent image is formed, the developing unit comprises:

a container containing a developer;

barriers to partition a portion from other portions within the container, such that a space defined by the barriers is not filled with the developer; and a sealing film to partition another space inside of the container and can be removed to unify the another space inside of the container without disassembling the container.

2. The developing unit claim 1, wherein the barriers are provided in a portion of the space inside the container partitioned by the sealing film.

3. The developing unit of claim 2, wherein the sealing film is disposed to partition the container into a top space and a bottom space, and spaces defined by the barriers are provided in the same side of the top space and bottom space.

4. The developing unit of claim 1, wherein slits in which end portions of the barriers are inserted are formed in the inside surface of the container.

5. An electrophotographic image forming apparatus equipped with a photosensitive medium, on which an electrostatic latent image is formed on an outer surface of the photosensitive medium by light scanning and a developing unit to develop an image by supplying a developer to the photosensitive medium, the developing unit comprising:

a container containing the developer; and barriers removeably attached to the container to partition the container, in which a space defined by the barriers is not filled with the developer, wherein a sealing film to partition a space inside of the container that can be removed to unify the space inside of the container without disassembling the container is provided, and the barriers are provided in a portion of the space inside the container partitioned by the sealing film.

6. The apparatus of claim 5 wherein the sealing film is disposed to partition the container into a top space and a bottom space, and spaces defined by the barriers are provided in the same side of the top space and bottom space.

7. The apparatus of claim 5, wherein slits in which end portions of the barriers are inserted are formed in the inside surface of the container.

8. A developing unit of an electrophotographic image forming apparatus comprising:

a developing member to develop an electrostatic image; and a container to contain developer therein, the container including:

a first sealing film to separate an inside of the container from the developing member, a second sealing film to partition the inside of the container into a first space containing the developer and a second space containing the developer, a first barrier provided in the first space to create a first region containing no developer, and a second barrier provided in the second space to create a second region containing no developer.

9. The developing unit of claim 8, wherein the first sealing film can be removed without dissembling the container, and the second sealing film can be removed without disassembling the container.

10. The developing unit of claim 9, wherein the developer contained in the first and second spaces leak out only when the first and second sealing films are removed, respectively.

11. The developing unit of claim 9, further comprising a residual developer detecting sensor to detect a residual amount of the developer, and the residual developer detecting sensor sends a message indicating that the second sealing film needs to be removed when the residual amount of the developer contained in the first space is determined to be below a predetermined amount.

12. The developing unit of claim 11, wherein the residual developer detecting sensor sends a message indicating that the container needs to be replaced when the residual amount of the developer contained in the second space is determined to be below a predetermined amount.

13. The developing unit of claim 8, wherein the first and second sealing films are composed of one of paper, urethane, polyethylene series, and polypropylene series.

14. The developing unit of claim 8, wherein the second sealing film is disposed horizontally at a center of the container and the first space is a bottom space and the second space is a top space.

15. The developing unit of claim 8, wherein the first region and the second region are disposed on a same side of the first space and the second space, respectively.

16. The developing unit of claim 8, wherein the container further comprises:

a first slit to accommodate an end portion of the first barrier; and a second slit to accommodate an end portion of the second barrier.

17. The developing unit of claim 16, wherein another end portion of the first barrier contacts an inner surface of the container and another end portion of the second barrier contacts the inner surface of the container.

18. The developing unit of claim 16, wherein the container further comprises:

a third slit to accommodate another end portion of the first barrier; and a fourth slit to accommodate another end portion of the second barrier.

19. The developing unit of claim 8, wherein the first barrier and the second barrier are removable.

20. A container containing a developer to be used with a developing unit of an electrophotographic image forming apparatus, the container comprising:

a plurality of sealing films partitioning the container into a plurality of spaces;

a plurality of removable barriers to partition the plurality of spaces into a plurality of developer filled spaces and a plurality of non-developer spaces containing no developer.

21. The container of claim 20, wherein each of the plurality of sealing films can be removed to allow the developer contained in each of the plurality of developer filled spaces to exit the container.

22. A container containing a developer to be used with a developing unit of an electrophotographic image forming apparatus, the container comprising:

a first compartment containing the developer and a first barrier to create a first region within the first compartment containing no developer; and a second compartment containing the developer, wherein the developer in the first and second compartments are used sequentially.

23. The container of claim 22, further comprising a sealing film to separate the first and second compartments.

24. The container of claim 23, wherein the sealing film can be removed without disassembling the container.

25. The container of claim 22, wherein the second compartment comprises a second barrier to create a second region within the second compartment containing no developer.

26. A container containing a developer to be used with a developing unit of an electrophotographic image forming apparatus, the container comprising:

a first compartment containing the developer; and a second compartment containing the developer, wherein the developer in the first and second compartments are used sequentially such that the developer in the second compartment flows through the first compartment to be used to develop images after the developer in the first compartment is fully depleted, wherein a sealing film to partition a space inside of the container that can be removed to unify the space inside of the container without disassembling the container is provided, and the barriers are provided in a portion of the space inside the container partitioned by the sealing film.

27. The container of claim 26, further comprising a sealing member disposed between the first compartment and the second compartment such that when the sealing member is removed the developer of the second compartment flows through the first compartment and then to the image forming apparatus to develop images.

* * * * *